United States Patent [19]

Alsch

[11] 4,360,720

[45] Nov. 23, 1982

[54] STEP SWITCH

[75] Inventor: Gottfried Alsch, Vienna, Austria

[73] Assignee: Hubert Laurenz Naimer, Ascona, Switzerland

[21] Appl. No.: 228,172

[22] Filed: Jan. 23, 1981

[30] Foreign Application Priority Data

Jan. 23, 1980 [AT] Austria ..... 355/80

[51] Int. Cl.[3] ..... H01H 5/16

[52] U.S. Cl. ..... 200/65

[58] Field of Search ..... 200/63 R, 63 A, 65, 200/66, 67 C, 64, 155 R, 62; 74/97

[56] References Cited

U.S. PATENT DOCUMENTS 1,643,210 9/1927 Guett ..... 200/65

3,283,596 11/1966 Roeser ..... 200/65

FOREIGN PATENT DOCUMENTS 68338 2/1928 Sweden ..... 200/65

*Primary Examiner*—John W. Shepperd

*Attorney, Agent, or Firm*—Kurt Kelman

[57] ABSTRACT

A step switch having contacts actuatable in predetermined indexed positions comprises a rotatable driving shaft and a coaxial driven shaft rotating an indexing mechanism into the indexed positions for actuating the contacts. A coupling is arranged between the shafts for indexing the rotary movement of the driven shaft in response to the rotation of the driving shaft. The coupling includes a driving coupling part keyed to the driving shaft, a driven coupling part keyed to the driven shaft, the coupling parts having peripheries coaxial with the shafts, a spring having two ends respectively engaging the coupling parts and being tensioned in the direction of the coupling part peripheries, and a shape-conforming blocking device controlled by the rotary position of the shafts in relation to each other for respectively blocking and unblocking the rotary movement of the driven coupling part.

6 Claims, 9 Drawing Figures

STEP SWITCH

The present invention relates to a step switch having contacts actuatable in predetermined index positions and comprising a rotatable driving shaft and a coaxial driven switching shaft rotating an indexing mechanism into the indexed positions for actuating the contacts.

In manually operated switches, the speed with which the movable contacts are removed from the fixed contacts is directly proportional to the rotary speed of the driving shaft. Therefore, if the driving shaft is rotated slowly, the slow separation of the contacts may result in the formation of very strong electric sparks, reducing the operating life of the contacts considerably and even causing the destruction of the switch by damaging the insulating supports of the contacts or burning out the contacts.

For this reason, switches have been proposed in which the speed of the contact movement is predetermined and is practically unrelated to the operation of the switch, as is the case in motor-driven switches. However, such switches are expensive and, furthermore, they depend on a source of energy which is not always available.

Manually operated switches in which the speed of the contact movement is independent of the speed of the switch actuation are also known. These switches, however, have only two switching positions and operate on the bell crank lever principle.

It is the primary object of this invention to provide a step switch with a multiplicity of indexed switching positions and in which the speed of the contact movement or actuation of the switch is independent of the actuating speed and the corresponding rotary speed of the driving shaft.

The above and other objects are accomplished according to the invention with a coupling arranged between the shafts for indexing the rotary movement of the driven shaft in response to the rotation of the driving shaft. This coupling includes a driving coupling part keyed to the driving shaft, a driven coupling part keyed to the driven shaft, the coupling parts having peripheries coaxial with the shafts, a spring having two ends respectively engaging the coupling parts and being tensioned in the direction of the coupling part peripheries, and a shape-conforming blocking device controlled by the rotary position of the shafts in relation to each other for respectively blocking and unblocking the rotary movement of the driven coupling part.

This arrangement makes it possible to unblock the driven coupling part only after the shafts have reached a predetermined relative angular position so that the tensioned connecting spring biases the driven coupling part with a pulling force sufficient to produce the desired speed of the contact movement, the control of the blocking device by the rotary movement of the driving shaft assuring at the same time that the driven coupling part is arrested and blocked in the first indexed position determined by the blocking device in the direction of rotation. This is obtained by the diminution of the angle of the relative rotary movement of the driving and driven shafts. This also assures that the switching shaft is successively retained in respective indexed positions and is released therefrom in succession as the driven shaft is rotated about an angle covering a succession of such positions, thus producing a stepped switching movement.

The above and other objects, advantages and features of the present invention will become more apparent from the following detailed description of certain now preferred embodiments thereof, taken in conjunction with the accompanying drawing wherein FIG. 1 shows an axial section of a rotary switch incorporating the coupling of this invention, in the rest position;

FIG. 2 is a like view illustrating the step switch in the position in which the driven switching shaft is unblocked;

FIGS. 3*a*, 3*b* and 3*c* are exploded perspective views of the coupling, FIG. 3*a* showing the coupling parts, the connecting spring and a front mounting part viewed from the front, FIG. 3*a* showing the driven coupling part, blocking means and a rear mounting part viewed from the front, and FIG. 3*c* showing the coupling parts view from the rear;

Figure 3:
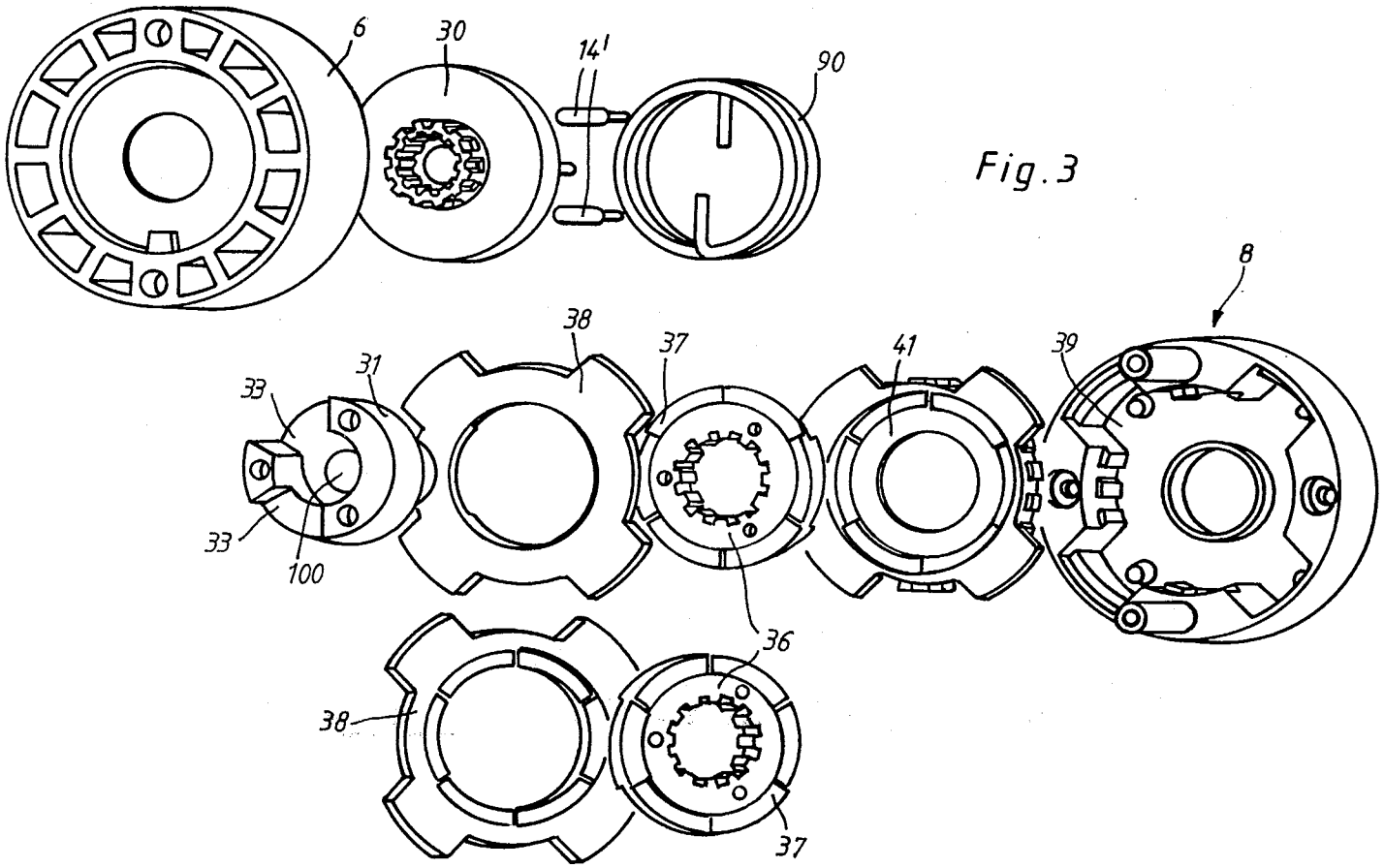
Figure 4:
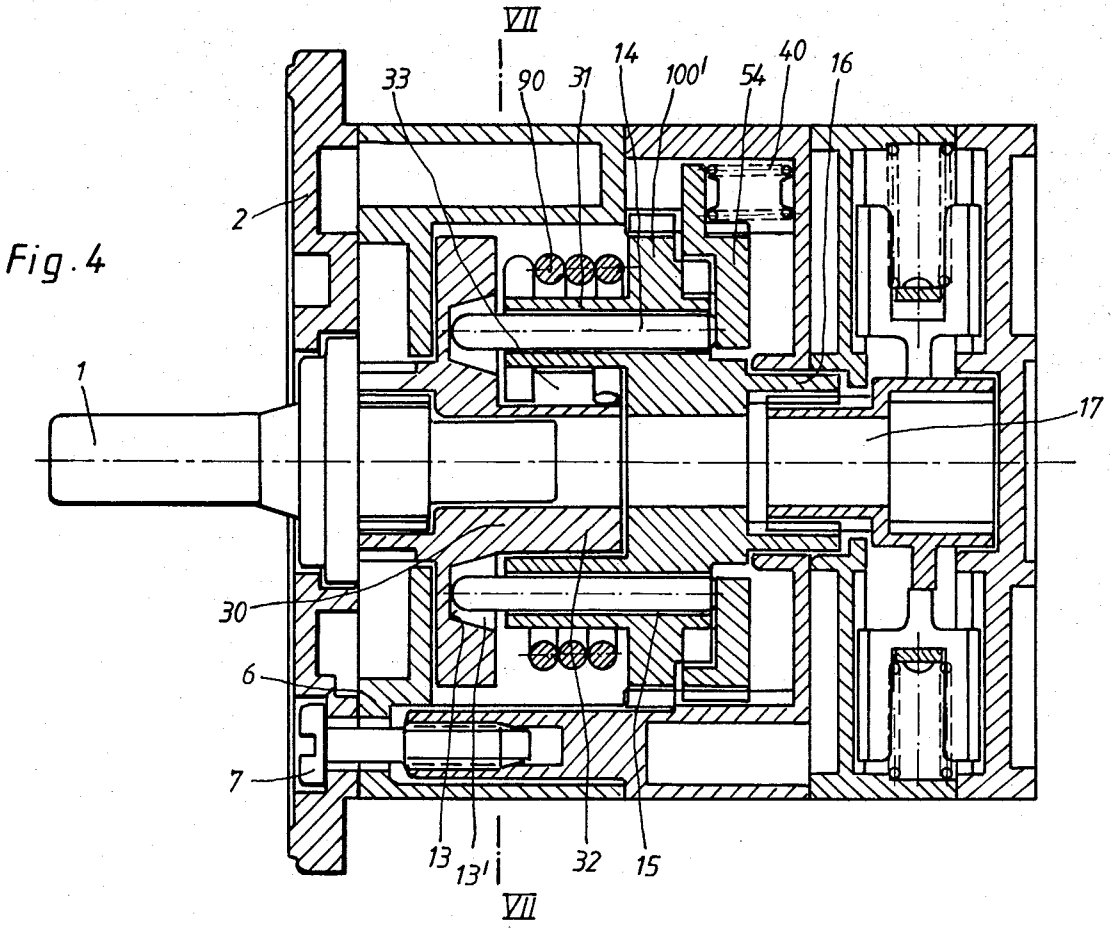
FIG. 4 is a sectional view similar to that of FIG. 1, illustrating a rotary switch designed for two switching positions.
Figure 5:
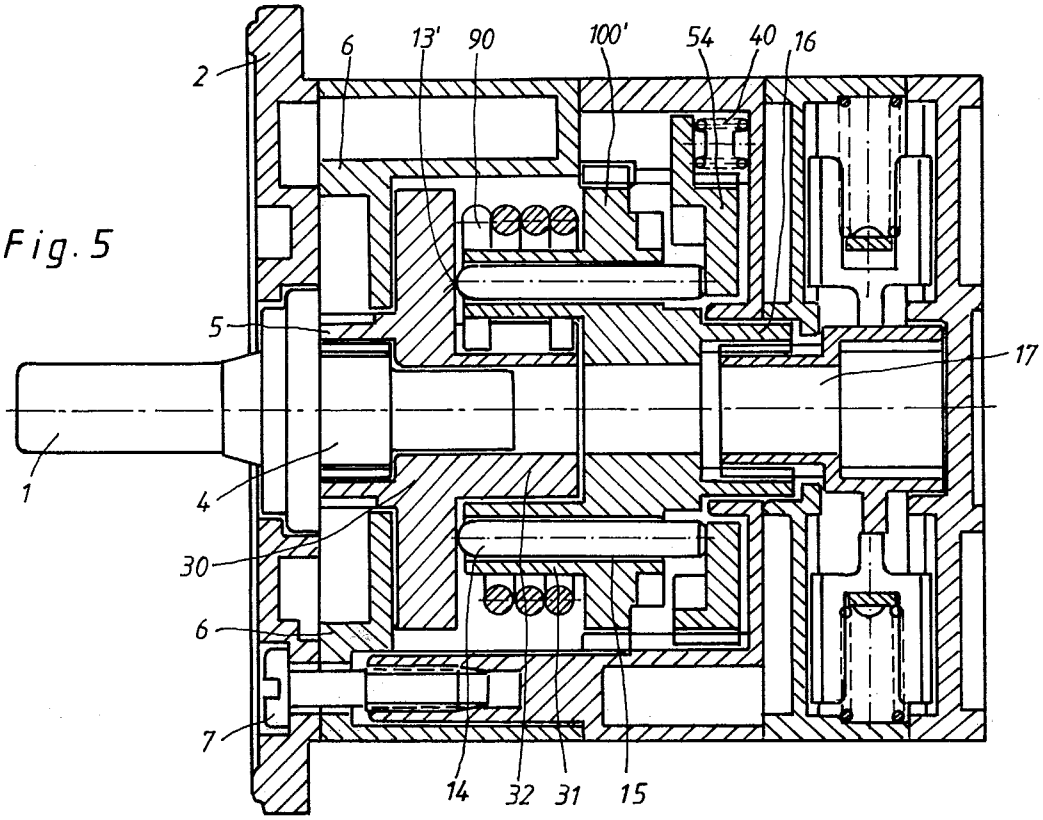
FIG. 5 shows the embodiment of FIG. 4, with the driven switching shaft unblocked.
Figure 6:
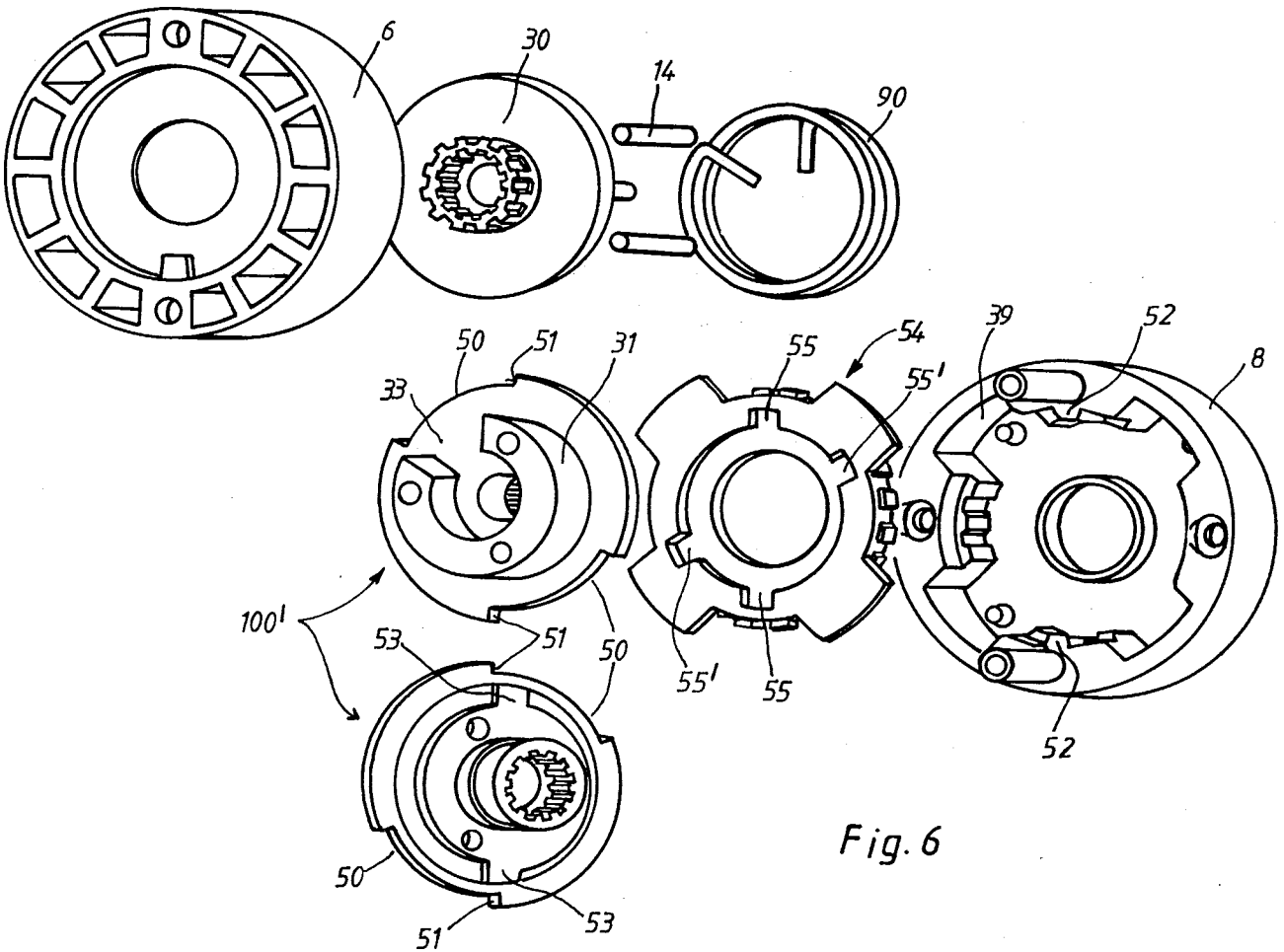
Figure 7:
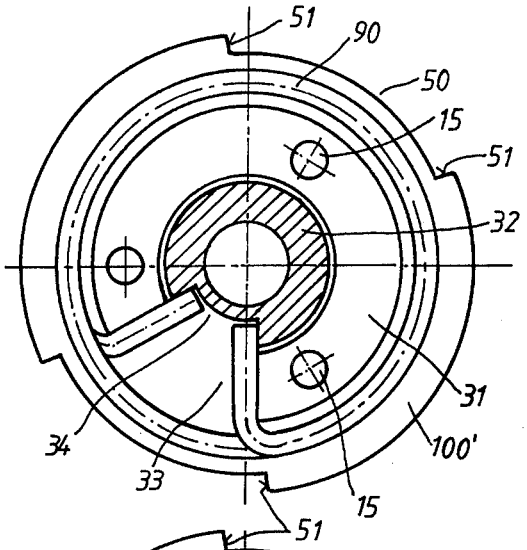
Figure 8:
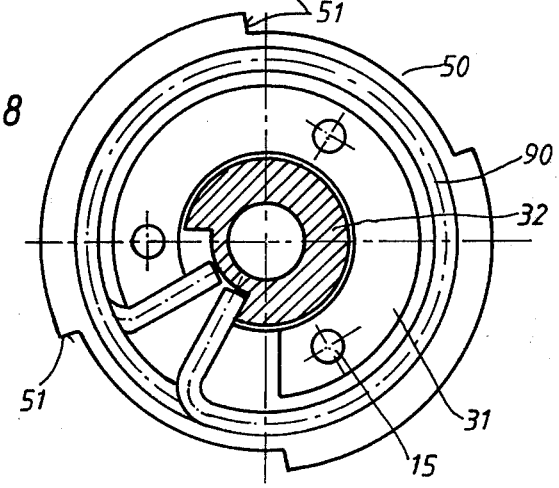
Figure 9:
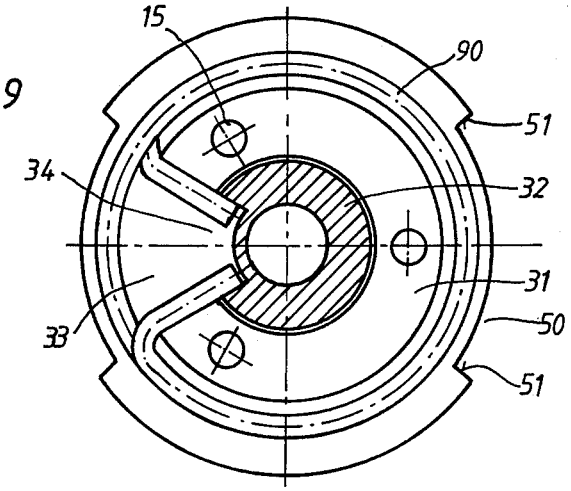

FIGS. 6*a*, 6*b* and 6*c* are exploded views like FIGS. 3*a*, 3*b* and 3*c* for the embodiment of FIGS. 4 and 5; and FIGS. 7 to 9 are transverse sections taken along line VII—VII of FIG. 4, illustrating different angular positions of the coupling parts.

Figure 1:
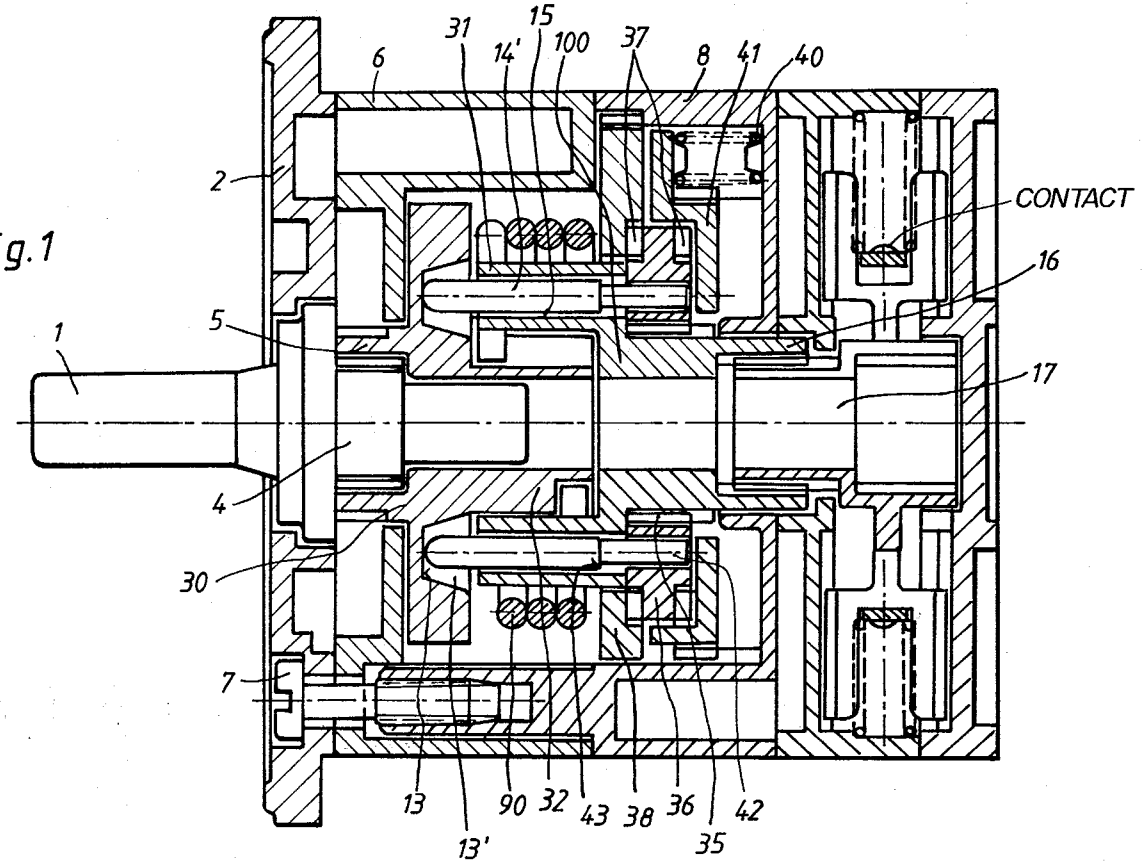
Figure 2:
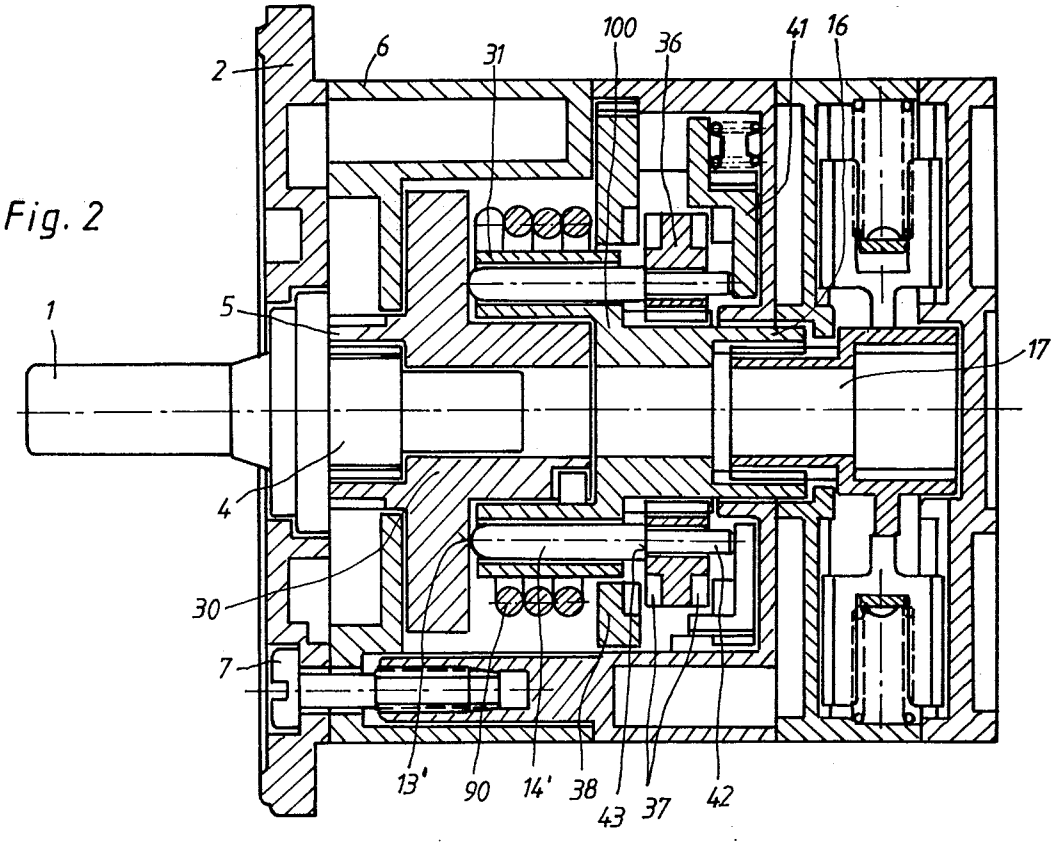

Referring now to the drawing and first to FIGS. 1 and 2, the switch is shown to comprise rotatable driving shaft 1 journaled in a central bore in cover plate 2. A suitable handle may be keyed to the driving shaft for rotation thereof and corresponding actuation of the switch. Driven switching shaft 17 is coaxial with driving shaft 1 and a coupling is arranged between the shafts for indexing the rotary movement of the driven switching shaft in response to rotation of the driving shaft.

The coupling includes driving coupling part 30 keyed to driving shaft 1 and driven coupling part 100 keyed to switching shaft 17, the coupling parts comprising discs having peripheries coaxial with the shafts and respective surfaces facing each other. The coupling parts are encased in a housing comprised of cup-shaped front part 6 and cup-shaped rear part 8, the front and rear housing parts being screwed together by screws 7 which connect the housing parts to cover plate 2 to form the switch housing. Front housing part 6 has a central bore coaxial with the shafts and hub 5 of driving coupling part 30 extends through the central bore and is internally tibbed for engagement with sprocket 4 on driving shaft 1. In this manner, coupling part 30 is driven by and with driving shaft 1.

As shown in the drawing, skirt 32 coaxial with, and surrounding driving shaft 1, projects from the disc of driving coupling part 30 and cylindrical skirt 31 projects from the disc of driven coupling part 100 and partially overlaps driving coupling part skirt 32. Each coupling part skirt defines respective recess 33, 34 extending between two radially extending walls which are coplanar in a rest position of the indexing mechanism whereby the recesses are in registry. Spring 90, which is illustrated as a coil spring surrounding skirt 31, has two ends respectively engaging coupling parts 30 and 100 and being tensioned in the direction of the coupling part peripheries, each of the spring ends projecting radially into a respective recess 33, 34. One of the spring ends engages the trailing wall of one of the recesses in a clockwise direction and the other spring end engages the leading wall of the other recess in a clockwise direction.

As appears from FIGS. 7 to 9, the radially extending walls of recesses 33, 34 enclose an angle of less than 90°, an angle of about 60° being preferred and illustrated, and as skirt 32 of driving coupling part 30 is rotated from the rest position shown in FIG. 7, the angle between the radially extending spring ends is reduced and the tension of spring 90 is correspondingly increased until, as will be described hereinafter, a blocking device releases driven coupling part 100 and this coupling part is biased by the tensioned spring to follow the rotational movement of the driving coupling part. This tensioning of coil spring 90 will occur regardless of the direction of the rotary movement of the driving coupling part.

This arrangement enables the parts to be readily assembled and makes it very easy to mount the spring which transmits the rotary movement from the driving to the driven shaft. Futhermore, the tension built into the coil spring at the time of the assembly produces a predetermined angular relationship in the rotary position of the shafts so that the positioning of the switch handle determines the switching position.

The coupling further includes a shape-conformed blocking device controlled by the rotary position of the shafts in relation to each other for respectively blocking and unblocking the rotary movement of the driven coupling part. Pins 14' axially movable in bores or bearing sleeves 15 in the driven coupling part control the blocking device. Control cam means 13 is arranged on the surface of driving coupling part 30 facing the surface of driven coupling part 100 and is engaged by one end face of pins 14'. The control cam means is an arcuate control cam having protuberances descending towards their respective ends at an angle of 45°, for example. The protuberances cause axial movement of pins 14' upon rotation of the driving shaft in relation to the driven shaft.

Driven coupling part 100 has an internally ribbed hub 16 passing through a central bore in rear housing part 8 and engaging a meshing sprocket on driven switching shaft 17 to enable the switching shaft to be rotated with the driven coupling part.

The other end faces of control pins 14' engage the blocking device. The blocking device illustrated in FIGS. 1 to 3 is designed for two or more switching positions. As shown, hub 16 of driven coupling part 100 has circumferentially arranged ratch teeth 35 engaging intermediate ratchet wheel 36 which is axially movable and rotatable with the driven coupling part. The intermediate ratchet wheel has two end faces each carrying an annularly arranged series of ratchet bosses 37 corresponding in number to the number of the desired switching positions. Fixed ratchet wheel 38 is held in the switch housing against rotary and axial movements and faces the series of ratchet bosses 37 on one end face of intermediate ratchet wheel 36 and the other end face of the intermediate ratchet wheel faces a fixed ratchet disc 41 which is non-rotatably but axially movably mounted in guide grooves 39 of rear housing part 8. Ratchet disc 41 is biased towards driven coupling part 100 by spring 40 and the ratchet disc is engageable with the ratchet bosses 37, the cooperation of the ratchet wheels and discs blocking rotation in both directions. As shown in FIGS. 1 and 2, intermediate ratchet wheel 36 defines bores receiving extensions 42 of control pins 14' and shoulders 43 of the pins are engageable with the end face of the intermediate ratchet wheel facing driving coupling part 30.

This construction assures in a simple manner the release of the blocking device when the angle of relative rotation of the coupling parts is exceeded while assuring the re-engagement practically immediately after release by the spring bias moving the blocking means towards the driven coupling part. In this manner, the blocking device will operate again when the next indexed position has been reached and will arrest the driven coupling part even if rotation of the driving shaft is continued. The arrangement of the bosses enables the indexed positions to be established very precisely and to be separate from each other by very small rotational angles. The driving shaft may be turned in either direction to position the driven switching shaft accurately in a respective indexed position determined by the shoulders of the bosses extending substantially perpendicularly to the surfaces thereof. Control pins 14' control the ratchet wheels. Arranging the control cam means with protuberances descending towards their respective ends, preferably at an angle of about 45°, has the advantage of releasing the ratchet wheel blocking means at an exactly predetermined angle of the relative rotation of the two coupling parts. It has the further advantage that the largest possible extent of engagement between the bosses on the ratchet wheels and the bosses on the driven coupling part is maintained during the largest part of the relative rotation of the coupling parts while it is then rapidly reduced, which prevents excessive contact of the bosses at their shoulders.

A blocking device of the described type also has the advantage of enabling the diameter of the indexing mechanism to be relatively small so that this mechanism may also be used for the operation of small switches. It is possible to dimension the ratchet detent means relatively large even though the diameter is small. The resultant reduced contact pressure areas correspondingly reduce the wear on the blocking means parts and thus increase the operating life of the mechanism.

The arrangement of a cylindrical skirt on the driven coupling part partially overlapping the driving coupling part, with the cylindrical skirt defining a respective recess having radially extending walls enclosing an angle of less than 90°, preferably about 60°, causes an advantageous distribution of the forces to which the driven coupling part is subjected during operation. It enables the two coupling parts to be rotated in relation to each other through a sufficiently large angle while the spring ends are supported on the walls of the recess in the cylindrical skirt, which reduces the flexing forces to which the skirt is subjected.

Control pins 14' whose extensions 42 are received in bores in intermediate ratchet wheel 36, one of whose ends engage spring-biased ratchet disc 41 and whose shoulders 43 are engageable with the intermediate ratchet wheels control the operation of the blocking device composed essentially of ratchet wheel 38, intermediate ratchet wheel 36 and ratchet disc 41. When driving coupling part 30 is rotated, control pins 14' will ride up protuberances 13' of control cam 13 after the coupling part has been rotated through a certain angle, thus pressing spring-biased ratchet disc 41 against the bias of springs 40 away from intermediate ratchet wheel 36, causing corresponding bosses 37 to be disengaged. If the detents of ratchet disc 41 block rotation in the direction in which driven coupling part 100 is biased by spring 90, intermediate ratchet wheel 36, and, therefore, the driven coupling part will be released at this point. However, if the driven coupling part is driven in the direction of rotation blocked by fixed ratchet wheel 38, control pins 14' will ride further up the protuberances 13' of control cam 13, causing pin shoulders 43 to engage intermediate ratchet wheel 36 and to move this intermediate ratchet wheel away from fixed ratchet wheel 38 whereby the intermediate ratchet wheel is disengaged.

As is illustrated in FIGS. 7 to 9, as driven coupling part begins to rotate, the rotational angle between the coupling parts is reduced and control pins 14' ride down protuberances 13', causing fixed ratchet wheel 38 and ratchet disc 41 to re-engage intermediate ratchet wheel 36. The next steep flank of the bosses of ratchet wheel 38 or ratchet disc 41 then blocks further rotation of intermediate ratchet wheel 36. At this point, springs 40 will press the associated bosses of intermediate ratchet wheel 36 into engagement with those of ratchet wheel 38 or ratchet disc 41 to block further rotation of the driven coupling part, this blocking action being further enhanced by the increasing wedging action between the bosses of ratchet wheel 38 or ratchet disc 41 and those of intermediate ratchet wheel 36 coming into engagement with each other. In this way, driven coupling part 100 will be securely held in position as successive indexing positions are reached even if there are a considerable number of indexed positions and the indexing mechanism is subjected to large forces due to the large number of switching planes of the step switch.

Unless otherwise indicated hereinafter, the parts of the embodiment of FIGS. 4 to 6 designated by the same reference numerals are of the same or equivalent structure operating in a like manner as those shown in FIGS. 1 to 3 and described hereinabove, coupling part 100' being equivalent to coupling part 100 and control pins 14 being equivalent to pins 14'.

In this embodiment, driven coupling part 100' defines two diametrically opposed peripheral recesses 50 which arcuately extend between radially extending abutment faces 51 serving to determine the two indexing positions for which this step switch is designed. The coupling is contained in the switch housing and rear housing part 8 has faces 52 alternatively engageable by abutment faces 51. The blocking device and driven coupling part have at least two detent means engageable in a respective indexed position. In the illustrated embodiment, driven coupling part 100' is held in position while coil spring 90 is tensioned during rotation of driving coupling part 30 by detent means comprising two bosses 53 on the end face of coupling part 100' facing away from driving coupling part 30, each delimiting two axially extending planes circumferentially spaced from each other and cooperating with blocking device 54. The blocking device has two pairs of diametrically opposed recesses 55, 55' corresponding to bosses 53, the angle enclosed by the recesses corresponding to the indexed positions. Blocking device 54 is held in grooves 39 of rear housing part 8 against rotation but is axially movable and biased against driven coupling part 100' by springs 40. Control pins 14 engage the blocking device in the above-described manner and control its operation accordingly. However, in this embodiment, driven coupling part 100' is not blocked by blocking device 54 when the next succeeding indexed position has been reached but is blocked by abutments 52 of the switch housing, whereupon blocking device 54 is re-engaged with the driven coupling part under the bias of springs 40.

In contrast to the embodiment of FIGS. 1 to 3, skirts 31 and 32 of the driven and driving coupling parts define only one recess 33, 34, which simplifies this structure and produces an advantageous force transmission. If desired, such a recess structure could also be used in the embodiment of FIGS. 1 to 3.

The structure of FIGS. 4 to 6 assures an exact holding of the driven coupling part until the two coupling parts have reached a predetermined relative angular rotary position and the blocking device is released from the driven coupling part by the movement of the control pins. Re-engagement is effected only when the driven coupling part is engaged with an abutment on the switch housing and has thus reached the indexed position. This makes it possible to keep the diameter of the indexing mechanism small while making the surfaces of the blocking device subject to impact forces rather large, thus assuring a long operating life.

What is claimed is:

1. A switch comprising a switch shaft for rotation of contact actuating means between switch positions, a drive shaft connected to the switch shaft by means of a coupling having input and output parts in the form of coaxial, spaced discs to which are attached on the adjacent faces hollow cylindrical skirts coaxial with the discs part of the length of one skirt lying within the other skirt, the outer skirt having one or more openings with radial walls and the inner skirt having a recess in register with each opening wherein the switch mechanism is at rest and the switch further comprising a coil spring which lies coaxial with and outside the skirts and has ends each formed so as to pass radially through an opening in the outer skirt and into a registering recess in the inner skirt, the spring being under tension in the rest position with the spring ends engaging ends of the recesses and openings, which tension is increased by relative rotation of the two discs and skirts, the output part of the coupling being blocked and released for rotation by a blocking device.

2. A switch according to claim 1, wherein the blocking device is non-rotatable and is axially biased by springs towards the output part of the coupling and the position of the blocking device is controlled by one or more axially displaceable pegs running through bores in the output part of the coupling which pegs have one end abutting cams on the face of the input coupling part facing the output part and the other end abutting the blocking device.

3. A switch according to claim 2, wherein the cams on the input part of the coupling have slopes rising or falling at an angle close to 45° to the plane of the face of the coupling part.

4. A switch according to claim 1, having two switch positions wherein the output part of the coupling has at least one pair of surfaces which abut a fixed detent in respective rest positions of the output part and the blocking device is furnished with at least two radial grooves or elevations corresponding to the rest positions which alternatively engage a corresponding elevation or groove respectively on the output part of the coupling.

5. A switch according to claim 1, wherein the blocking device is a ratchet wheel biased against the output part of said coupling which is axially movable but non-rotatable and can engage an intermediate ratchet disc between it and a further ratchet wheel fixed in the housing of said switch, the intermediate ratchet disc being axially moveable but non-rotatable with respect to the output part of the coupling and being provided with ratchet bosses on both surfaces which can mesh with corresponding bosses on said ratchet wheel fixed in the housing of said switch and the axially movable but non-rotatable ratchet wheel and the intermediate ratchet disc being pierced by the pegs which have shoulders which can abut the intermediate ratchet disc on the face adjacent the output part of the coupling.

6. A switch according to claim 1, wherein the openings and recesses in the skirts have radial walls subtending an angle less than 90°.

* * * * *